US005957729A

United States Patent [19]

Federowicz

[11] Patent Number: 5,957,729

[45] Date of Patent: Sep. 28, 1999

[54] QUICK TERMINATION MODULAR CONNECTOR

[76] Inventor: John S. Federowicz, 568 Browns Rd., Storrs, Conn. 06268

[21] Appl. No.: 08/895,957

[22] Filed: Jul. 17, 1997

Related U.S. Application Data

[60] Provisional application No. 60/021,985, Jul. 18, 1996.

[51] Int. Cl.[6] ..... H01R 9/03

[52] U.S. Cl. ..... 439/656; 439/936

[58] Field of Search ..... 439/676, 930, 439/656, 733.1

[56] References Cited

U.S. PATENT DOCUMENTS 4,842,544 6/1989 Birch et al. ..... 439/387

5,564,951 10/1996 Attal et al. ..... 439/676

*Primary Examiner*—Paula Bradley

*Assistant Examiner*—Antoine Ngandjui

*Attorney, Agent, or Firm*—John H. Crozier

[57] ABSTRACT

In a preferred embodiment, a quick termination modular connector, including: a housing; a first opening defined through a surface of the housing to accept removably secured therein at least one first wire; at least one spring contact disposed in the housing; a second opening defined through a surface of the housing to accept removably secured therein at least one second wire; and when the at least one first wire is inserted in the first opening and the at least one second wire is inserted in the second opening, the at least one first wire and the at least one second wire will engage the at least one spring contact and the at least one spring contact will thereafter maintain electrical contact therebetween with constant, positive pressure without the use of a mechanical fastener.

7 Claims, 9 Drawing Sheets

QUICK TERMINATION MODULAR CONNECTOR

CROSS-REFERENCE TO RELATED DOCUMENT AND APPLICATION

The present invention was disclosed in Disclosure Document No. 389470, dated Dec. 26, 1995. Benefit is claimed of the filing date of U.S. Provisional Application No. 60/021,985, filed Jul. 18, 1996.

BACKGROUND OF THE INVENTION

1. Field of the Invention

The present invention relates to modular connectors generally and, more particularly, but not by way of limitation, to a novel quick termination modular connector.

2. Background Art

Modular connectors are used in a variety of telecommunications, computer, and like systems for joining relatively thin wires to modular plugs. Many conventional modular connectors are relatively complicated and use more than two points of contact between the wires and the contact member in the modular body. Obviously, the greater the number of point contact points the greater the possibility of signal loss or degradation, not to mention the increased cost of manufacture. Other means of point contact used are screws, insulation displacement contacts, twisted and capped wires, grouped contacts, and soldering. Many applications use a combination of these methods.

All the above methods, in addition to relatively high manufacturing cost and possible quality problems, are relatively time consuming, and when a large number of such connections are to be made, the time consumed can be a significant cost factor.

Accordingly, it is a principal object of the present invention to provide a modular connector that is relatively simple and economical to manufacture.

It is a further object of the invention to provide such a modular connector to which wires can be attached.

It is an additional object of the invention to provide such a modular connector that is simple and easy to use for daisy chaining connections.

It is another object of the invention to provide such a modular connector that provides for self-scrubbing, positive contact, constant pressure wire termination without the need for the use of mechanical fasteners.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a quick termination modular connector, comprising: a housing; first opening means defined through a surface of said housing to accept removably secured therein at least one first wire; at least one spring contact disposed in said housing; second opening means defined through a surface of said housing to accept removably secured therein at least one second wire; and when said at least one first wire is inserted in said first opening means and said at least one second wire is inserted in said second opening means, said at least one first wire and said at least one second wire will engage said at least one spring contact and said at least one spring contact will thereafter maintain electrical contact therebetween with constant, positive pressure without the use of a mechanical fastener.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
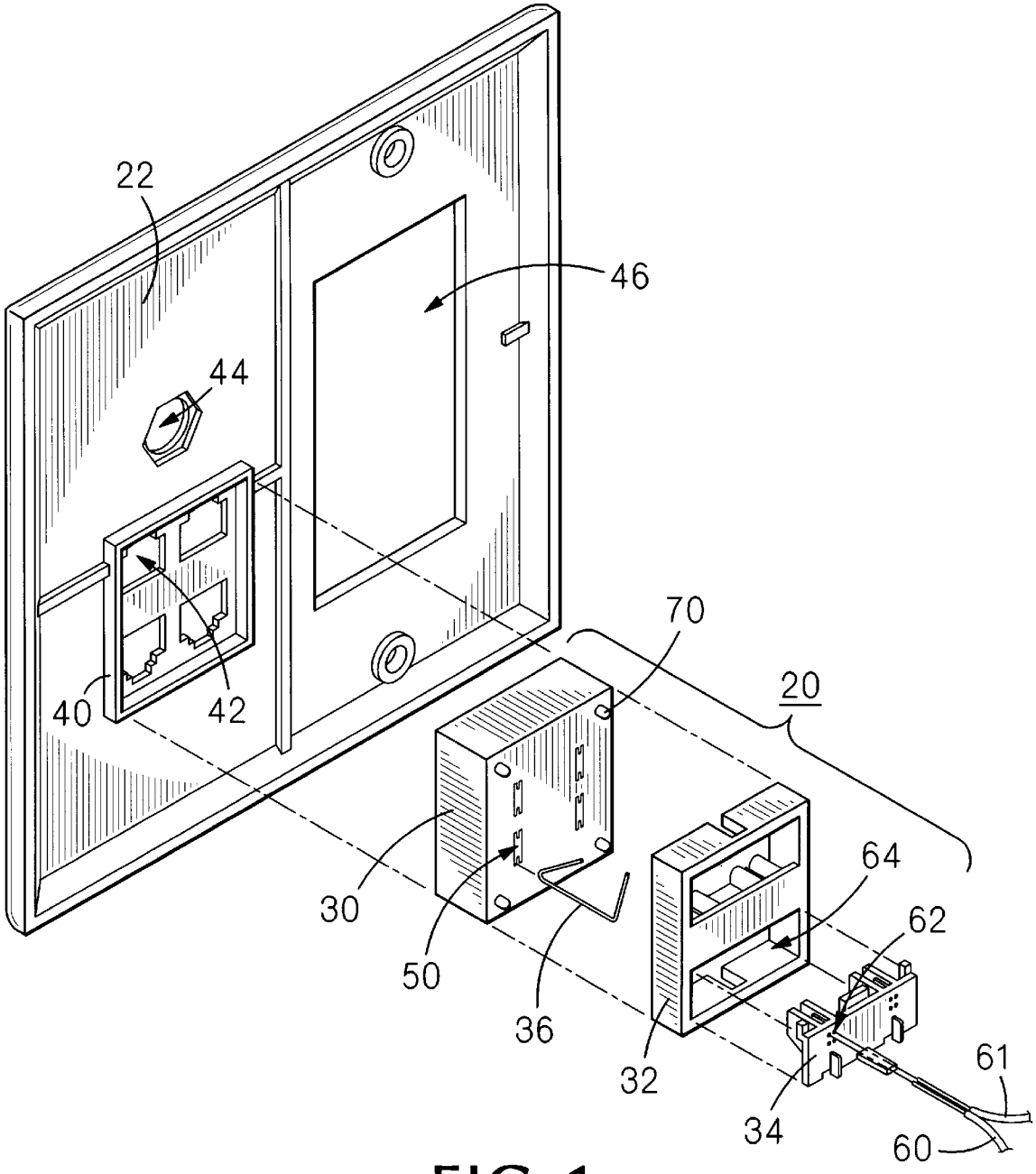
FIG. 1 is a fragmentary, exploded, isometric view of a modular connector constructed according to the present invention, a face plate to which the connector is to be mounted, and a pair of wires to be attached to the connector.

Reference should now be made to the drawing figures, on which similar or identical elements are given consistent identifying numerals throughout the various figures, and on which parenthetical references to figure numbers direct the reader to the view(s) on which the element(s) being described is (are) best seen, although the element(s) may be seen also on other views.

FIG. 1 illustrates a modular connector, generally indicated by the reference numeral 20, constructed according to the present invention, for mounting to the rear of a faceplate 22. Modular connector 20 includes a front housing member 30, a rear housing member 32, at least a first door member 34, and at least one, gold-plated, phosphor-bronze, spring wire contact 36. The thickness of the gold plating is about 50 millionths of an inch.

Modular connector 20 is mounted to the rear of faceplate 22 by means of front housing member 30 being inserted into a flange structure 40 integral with the faceplate and closely fitting around the perimeter of the front housing member, the front housing being secured therein by conventional adhesive means. Disposed internally of flange structure 40 and defined through faceplate 22 are a plurality of openings, as at 42, for the insertion therethrough into modular connector 20 of connector plugs of conventional design (not shown). Also defined through faceplate 22 are openings 44 and 46 to accommodate other types of connectors (not shown). It will be understood that faceplate 22 will be mounted to a wall or other such planar surface.

Front housing 30 includes a plurality of H-shaped openings defined therein, as at 50, for the insertion in one side of one of which openings a spring wire contact 36. The openings may also be conventional side-by-side slots (not shown) of any desired number. A pair of wires 60/61 having insulation stripped from the ends thereof is shown positioned for insertion into one of a plurality of pairs of holes, as at 62, defined in first door member 34, the details of which are described below. First door member 34 is then inserted into a first opening 64 defined in rear housing 32.

Front housing 30 includes four locator pins, as at 70, extending therefrom for insertion in the front side of rear housing member 32 to correctly position the two housing members while they are adhesively co-joined.

Figure 2:
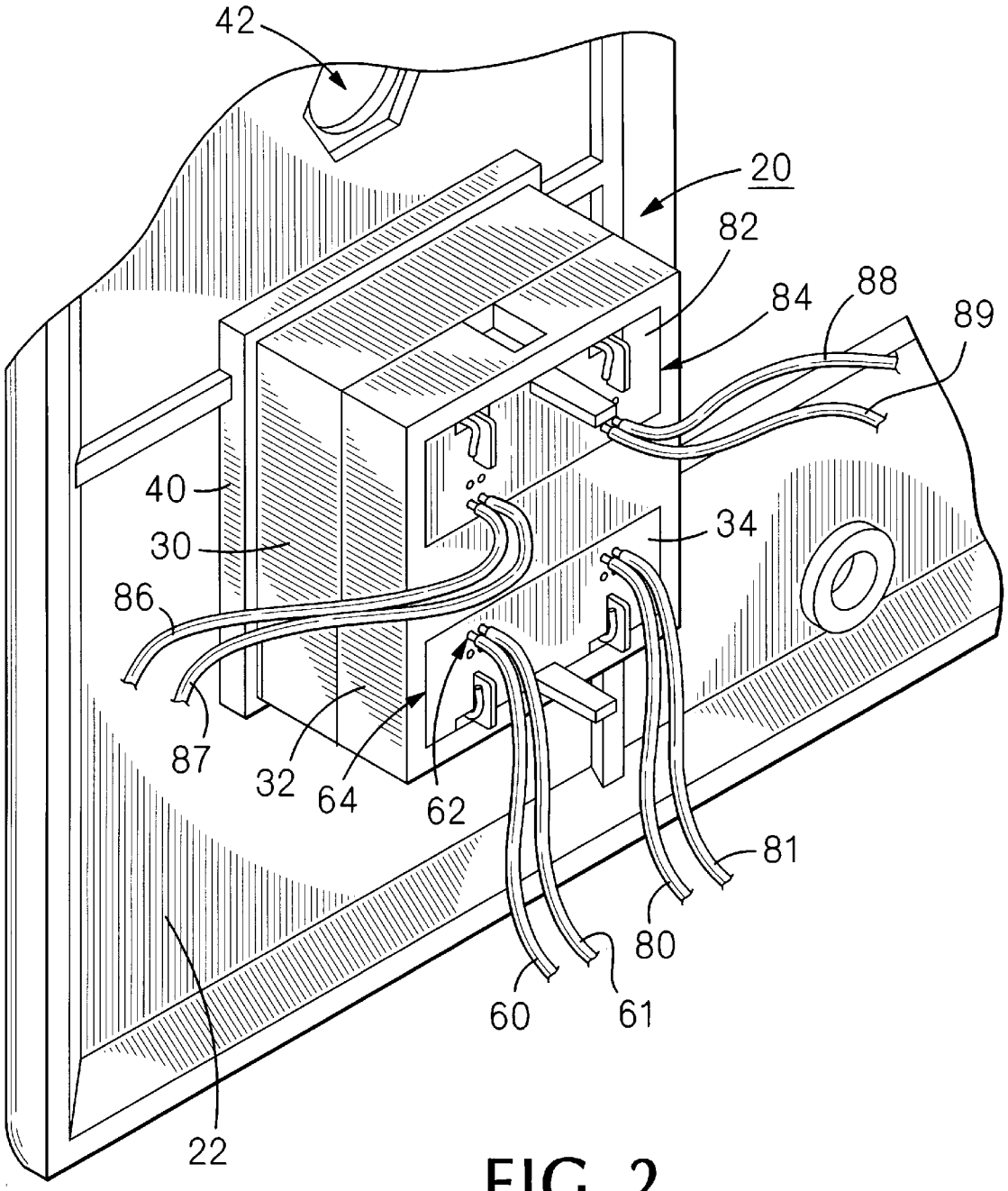
FIG. 2 is an isometric view of the modular connector mounted in the faceplate and with wires attached thereto.

FIG. 2 illustrates modular connector 20 fully assembled, with another pair of wires 80/81 inserted in first door member 34. Also shown, is a second door member 82 inserted in a second opening 84 defined in rear housing 32 and having inserted therein two pairs of wires 86/87 and 88/89.

Figure 4:
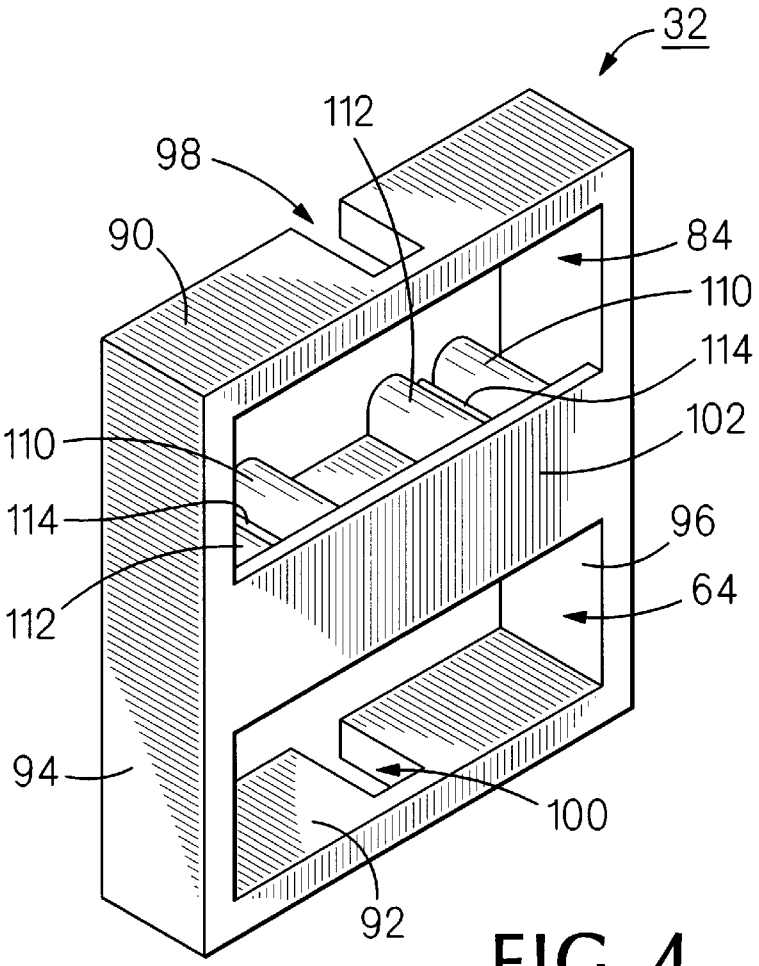
FIGS. 3 and 4 are isometric views of the rear housing member of the connector.
Figure 3:
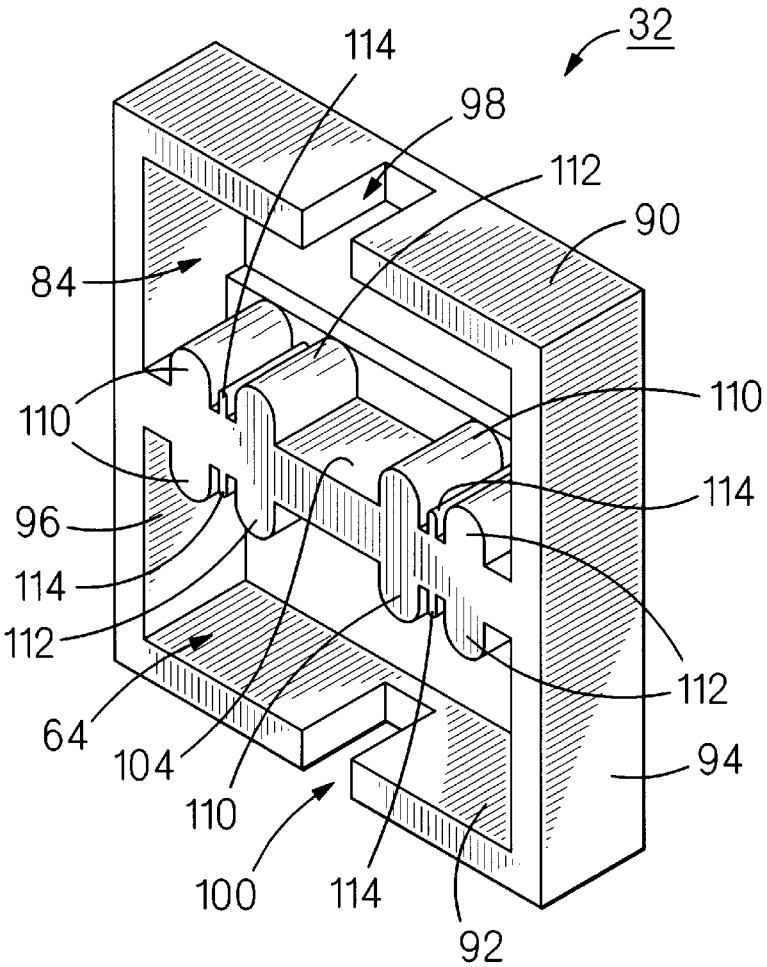

FIGS. 3 and 4 illustrates the structural details of rear housing 32 which has an overall shape in the form of a rectilinear parallelepipedon. Rear housing 32 is a monolithic injection molded thermoplastic part and includes top and bottom walls 90 and 92, respectively, and first and second side walls 94 and 96, respectively. Top and bottom walls 90 and 92 have slots 98 and 100 defined therethrough, respectively, the function of which is described below. A partial rear wall 102 extends between side walls 94 and 96 and forms the lower and upper edges, respectively, of second opening 84 and first opening 64. A horizontal ledge 104 midway between top and bottom walls 90 and 92 extends between the inside surface of rear wall 102, the inside surfaces of side walls 94 and 96, and the front surface of rear housing member 32. Formed on the upper and lower surface of ledge 104 are four pairs of spaced apart vertical side flanges 110/112 extending between the inside surface of rear wall 102 and the front surface of rear housing member 32. Each pair of side flanges 110/112 has disposed midway between facing surfaces of the side flanges a vertical intermediate flange 114, somewhat shorter in height than the side flanges, but coextensive in length therewith (FIG. 3).

Figure 6:
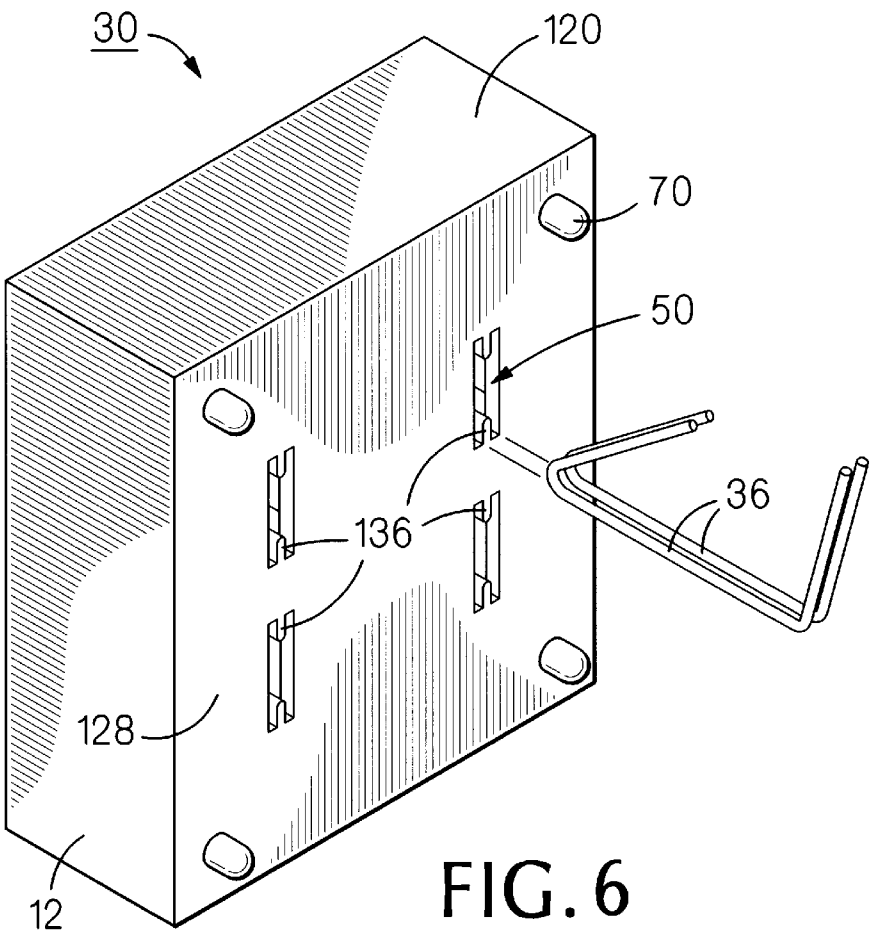
FIGS. 5 and 6 are isometric views of the front housing member of the connector also showing how a pair of wire spring contacts is inserted in the front housing member.
Figure 5:
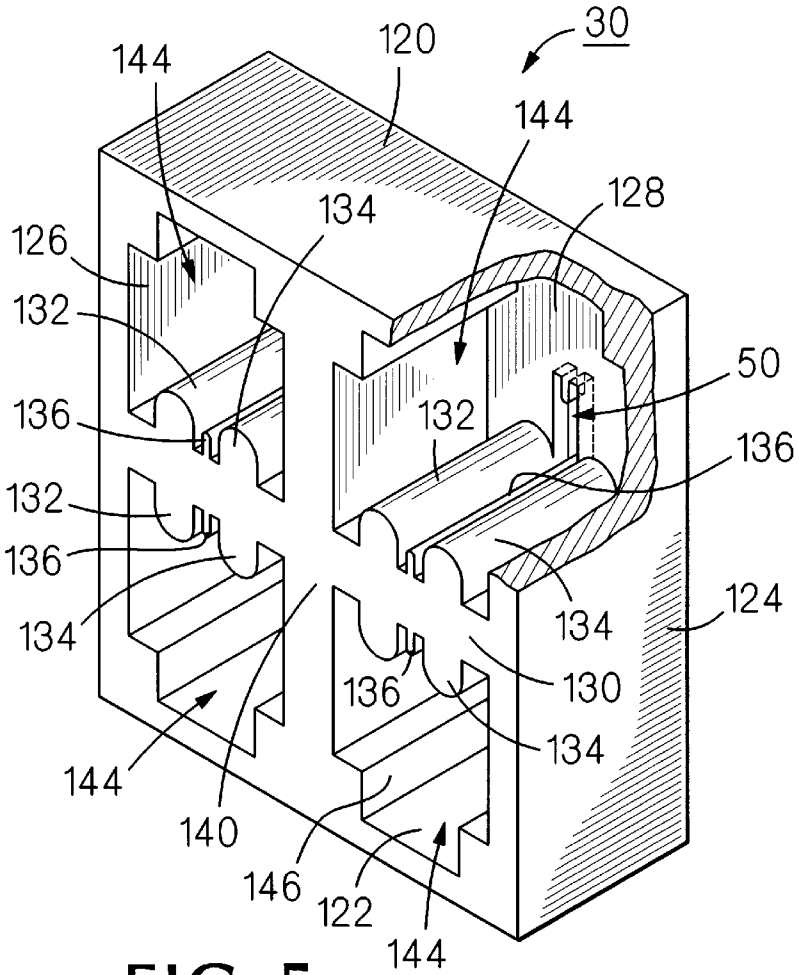
Figure 8:
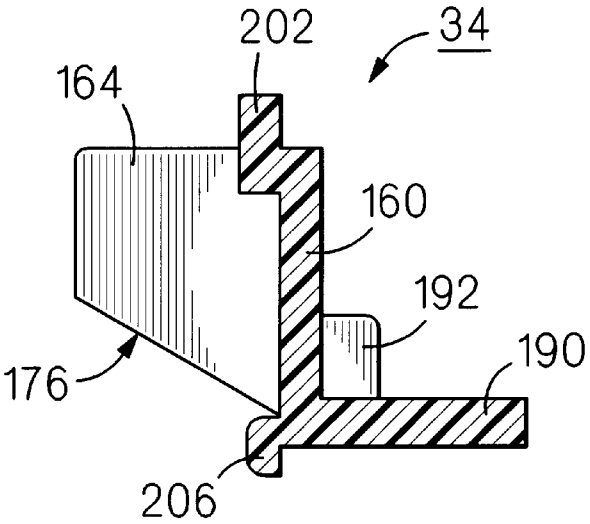
FIG. 8 is a side elevational view, in cross-section, taken along line "8—8" of FIG. 7.
Figure 7:
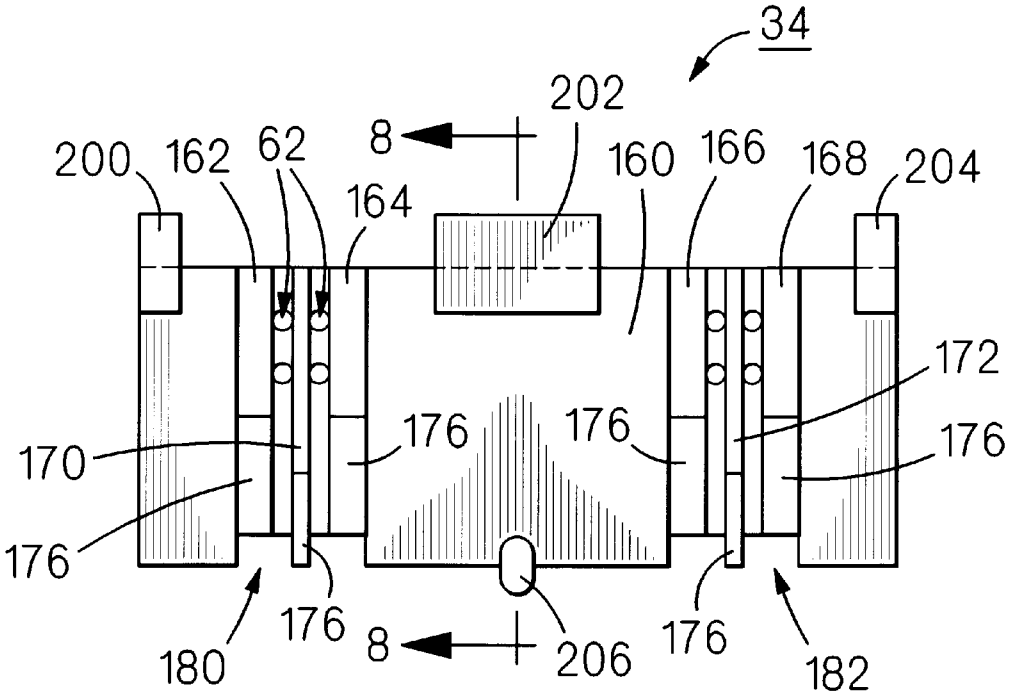
FIG. 7 is a rear elevational view of the door member of the connector.
Figure 10:
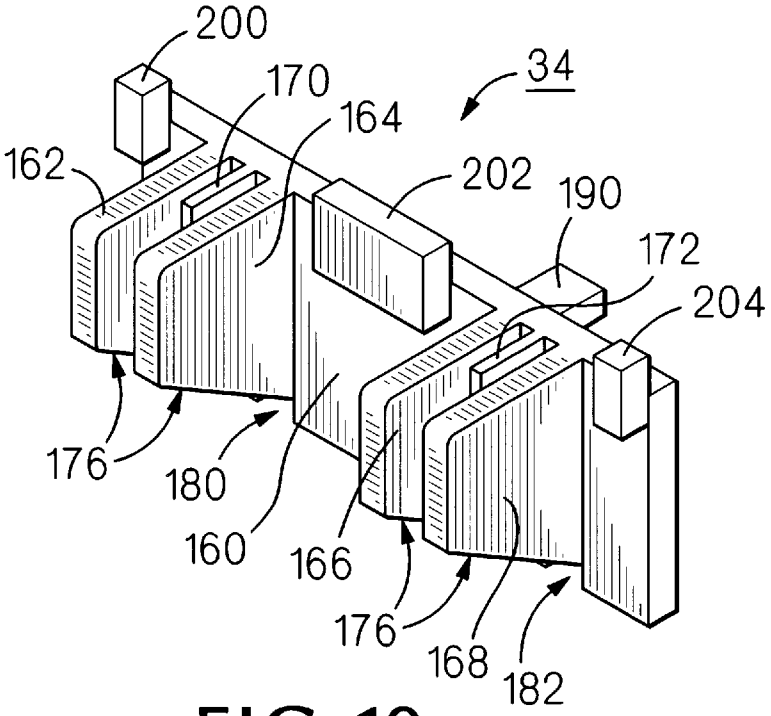
FIGS. 9 and 10 are isometric views of the door member of the connector.
Figure 9:
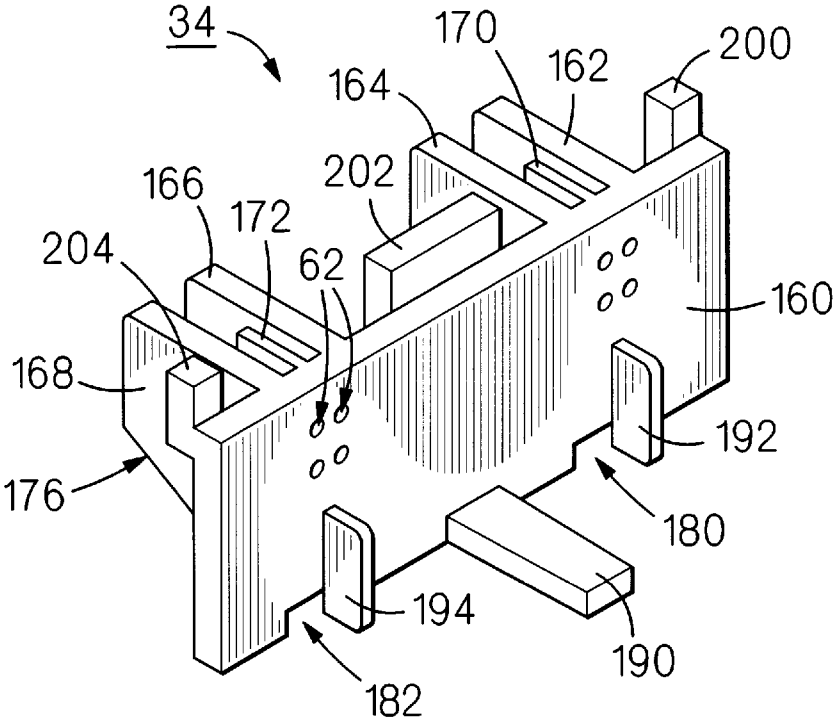

FIGS. 5 and 6 illustrates the structural details of front housing 30 which has an overall shape in the form of a rectilinear parallelepipedon, the structural details of which being somewhat similar to those of rear housing 32. Front housing 30 is a monolithic injection molded thermoplastic part and includes top and bottom walls 120 and 122, respectively, and first and second side walls 124 and 126, respectively. A rear wall 128 closes the rear surface of front housing member 30. A horizontal ledge 130 midway between top and bottom walls 120 and 122 extends between the inside surface of rear wall 128, the inside surfaces of side walls 124 and 126, and the front surface of front housing member 30. Formed on the upper and lower surface of ledge 130 are four pairs of spaced apart vertical side flanges 132/134 extending between the inside surface of rear wall 128 and the front surface of front housing member 30. Each pair of side flanges 132/134 has disposed midway between facing surfaces of the side flanges a vertical intermediate flange 136, somewhat shorter in height than the side flanges, with each intermediate flange extending between the front surface of front housing 30 and through opening 50 to the inside surface of rear wall 128. A vertical wall 140 midway between first and second side walls 124 and 126 extends between top and bottom walls 120 and 122, the inside surface of rear wall 128, and the rear surface of front housing 30

So constructed, front housing 30 includes four chambers 144 defined by the elements of front housing member 30, each chamber having fillets, as at 146, disposed at the corners of the chamber opposite ledge 130, thus presenting a shape complementary to that of a common connector plug which can be inserted therein through an opening 42 in faceplate 22 (FIG. 1).

Referring primarily to FIG. 6, it is shown more clearly how two spring wire contacts 36 may be inserted into the sides of an H-shaped opening 50. It will be understood that, when so inserted, the horizontal portions of spring wire contacts 36 will rest on ledge 130 (FIG. 5) on either side of an intermediate flange 136 and will be held in the upright position shown by engagement therewith by a pair of the side flanges 132/134 and the intermediate flange, each slot formed by those elements having a width approximately equal to the diameter of a spring wire contact. Similarly, other pairs of spring wire contacts will be inserted in the other of H-shaped openings 50.

FIGS. 7–10 illustrate the structural details of first door member 34, the details of second door member 82 (FIG. 2) being the same as the first door member except for the orientation thereof. Door member 34 is an injection molded monolithic thermoplastic part and includes a vertical main wall member 160 having four pairs of holes, as at 62, defined therethrough. Two pairs of vertical, spaced apart side flanges 162/164 and 166/168 extend from the rear surface of main wall member 160 and the pairs of side flanges have disposed between the flanges of each pair, respectively, intermediate flanges 170 and 172, each of all of the flanges having a sloped lower edge 176 extending downwardly from the distal edge of the flange to the top of one of two cutouts 180 and 182 defined in the lower edge of main wall member 160. It can be seen that each one of a pair of holes 62 is disposed between a side flange and an intermediate flange; for example, between side flange 162 and intermediate flange 170. Thus, wires inserted through holes of a pair of holes 62 will be isolated from each other by means of, for example, intermediate flange 170.

Door member 34 also includes, extending from the front surface of main wall member 160, a horizontal tab handle 190 and two vertical isolation flanges 192 and 194, the latter being disposed below points intermediate holes of pairs of holes 62 and extending, respectively, past cutouts 180 and 182 to the lower edge of main wall member 160. Three mounting flanges 200, 202, and 204 extend upwardly from the rear surface of main wall member 160 above the upper edge thereof and a mounting nub 206 extends downwardly from the rear surface of the main wall member below the lower edge thereof.

Figure 12:
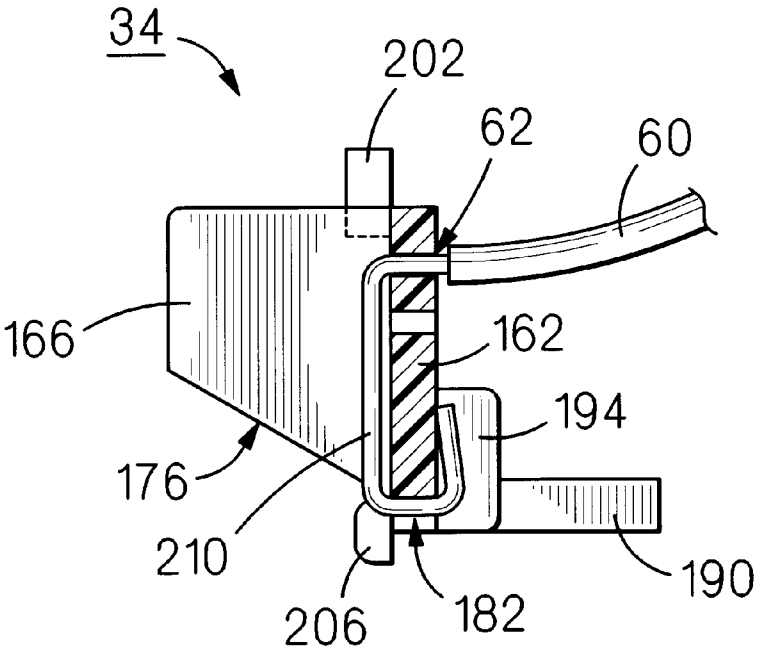
FIGS. 11 and 12 are side elevational views, in cross-section, showing how a wire is inserted into and attached to the door member.
Figure 11:
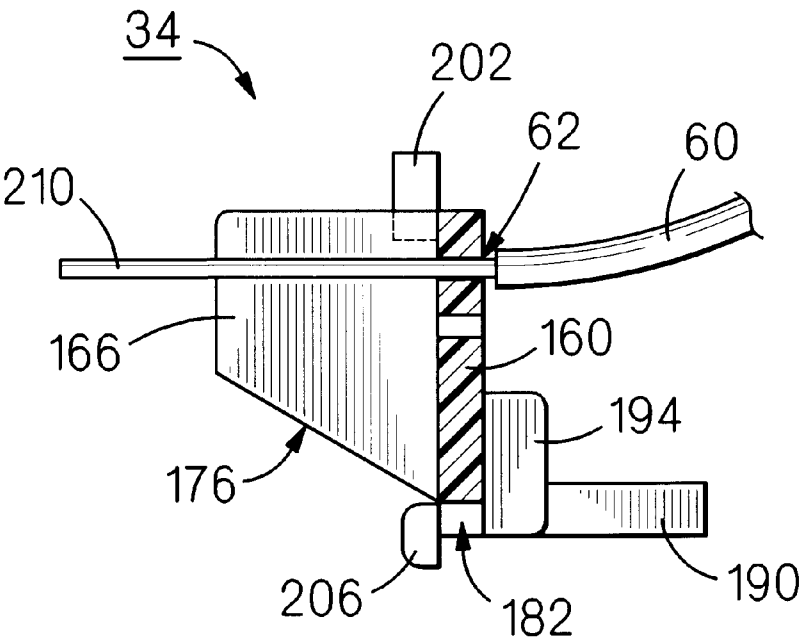

FIGS. 11 and 12 illustrate how a wire is attached to door member 34. First (FIG. 11), the stripped end 210 of wire 60 is inserted through a hole 62 from the front surface of main wall member 160. Next (FIG. 12), end 210 is bent downwardly 90 along the rear surface of main wall member 160, bent forwardly 90 degrees along the upper edge of cutout 182, and then bent upwardly 90 degrees along the front surface of the main wall member. Thus, wire 60 is quickly and securely fastened to door member 34. It will be understood from inspection of FIGS. 7–12 that each such wire will be isolated from another wire of a pair of wires by an intermediate flange on the rear surface of main wall member 160 and by an isolation flange on the front surface of the main wall member and that each wire will be supported against sideways motion by a side flange and an intermediate flange on the rear surface of the main wall member. The widths of the slots formed by these members is approximately equal to the diameter of stripped end 210.

Figure 14:
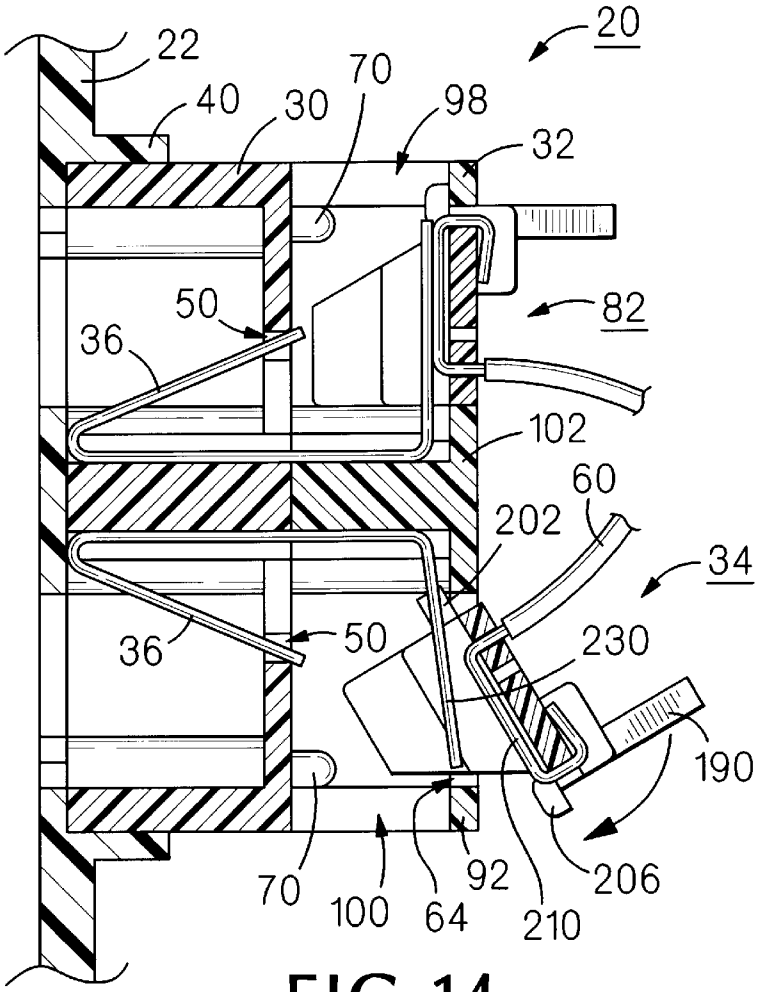
FIGS. 13 and 14 show how the door member, with a wire inserted therein, is attached to the rear housing member.
Figure 13:
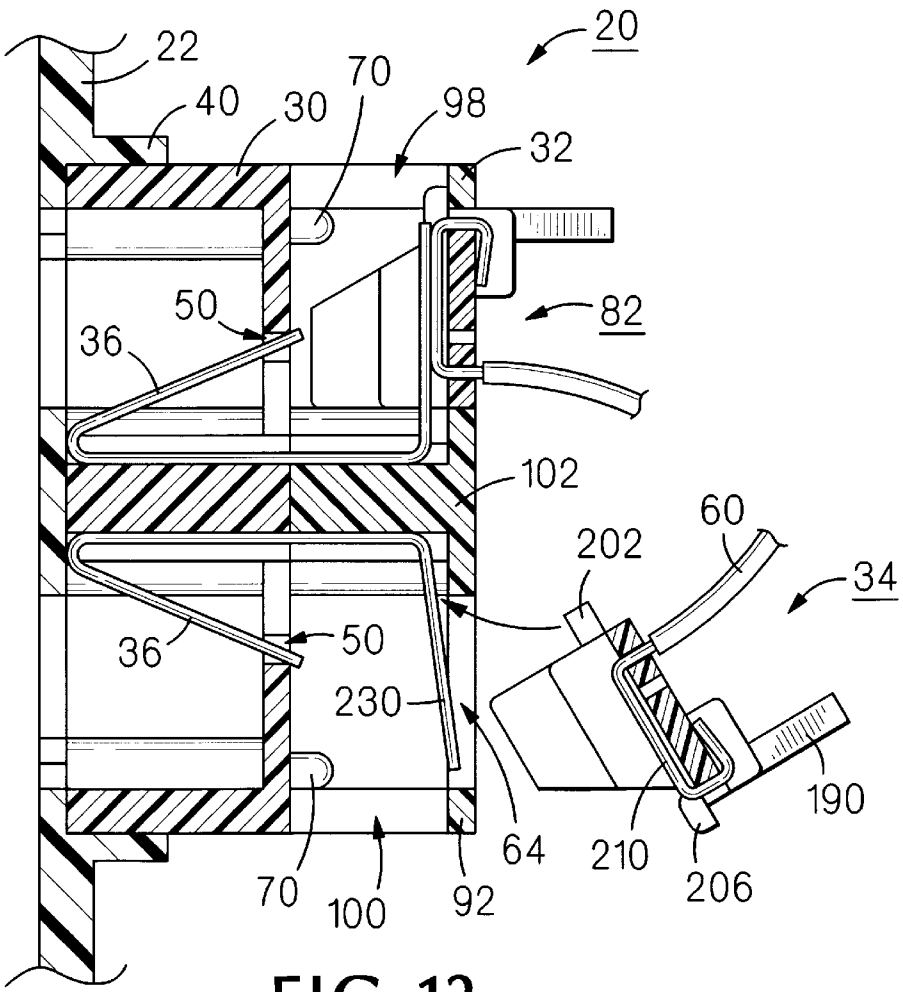

FIGS. 13 and 14 illustrate details of how modular connector 20 is assembled and first door member 34 inserted therein, second door member 82 being shown as having already been inserted in the connector. First, front housing member 30 is inserted into flange structure 40 of faceplate 22 (FIG. 1) and adhesively attached thereto. Next, rear housing 32 member is positioned adjacent front housing member 30 using locator pins 70 and the two housings are adhesively cojoined. Then, spring wire contacts 36 are inserted through H-shaped holes 50 in the rear surface of front housing member 30 (FIG. 1).

Now, tab handle 190 of first door member 34 with wire 60 attached thereto is manually grasped and mounting flange 202 is inserted into first opening 64 and behind rear wall 102 of rear housing member 32 (FIG. 4). Then, first door member 34 is rotated about the contact point of mounting flange 202 and rear wall 102, as indicated by the arrow on FIG. 14, and mounting nub 206 engages lower wall 92 of rear housing member 32 (FIG. 4), causing elastic deformation of the first door member until the mounting nub snaps into slot 100 (FIG. 4).

It will be understood, with reference to fully inserted second door member 82, that, as first door member 34 is inserted in rear housing member 32, there will be a cleaning wiping action between end 210 of wire 62 and the vertical portion 230 of spring wire contact 36. Furthermore, there will be a long, single point, positive contact between end 210 and vertical portion 230, with constant pressure furnished by the biasing force of the vertical portion. First door member 34 will be releasably secured in rear housing member 32 by means of mounting flange 202 (and mounting flanges 200 and 204, not shown) and mounting nub 206 opposing the biasing force of vertical portion 230 of spring wire contact 36.

Figure 16:
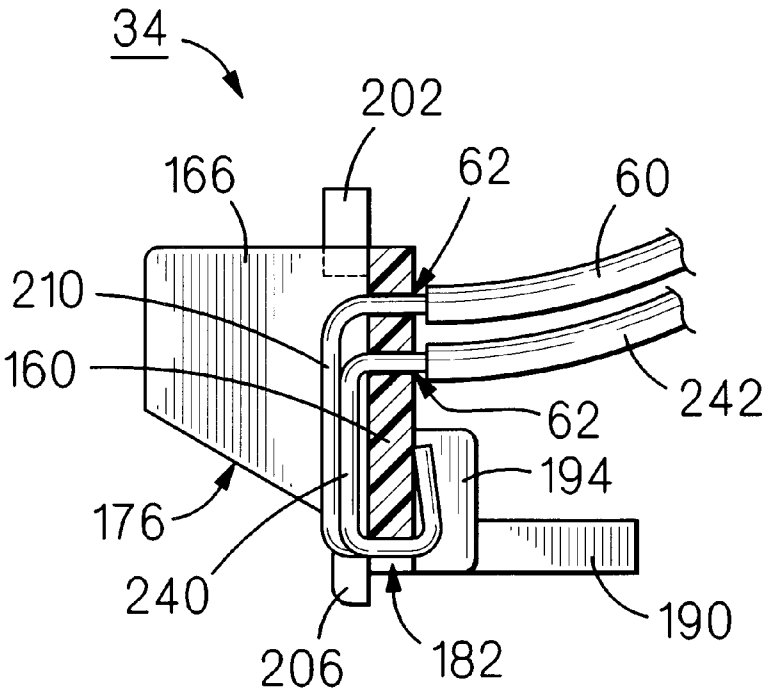
FIGS. 15 and 16 are side elevational views, in cross-section, showing how a "daisy chain" wire is inserted into and attached to the door member.
Figure 15:
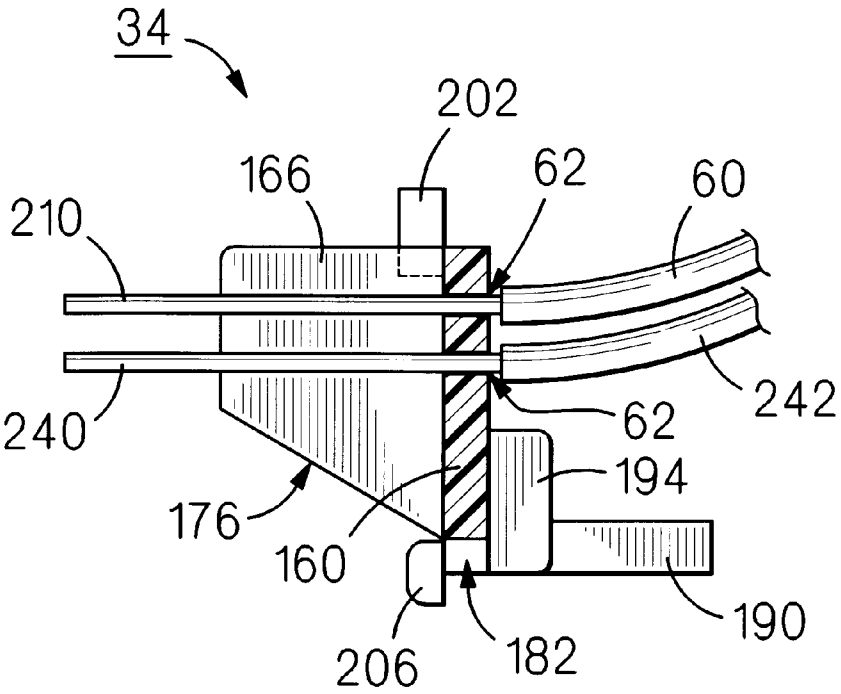

FIGS. 15 and 16 illustrate how daisy chaining may be provided with modular connector 20. Here, the stripped end 210 of wire 60 is inserted into one hole 62 of an upper pair of holes and the stripped end 240 of a wire 242 is inserted into a hole 62 of a lower pair of holes, the stripped ends being inserted into holes that are vertically aligned. Then, stripped end 240 is bent around main wall member 160 in the manner described above for stripped end 210 (FIGS. 11 and 12) and then stripped end 210 is bent around the main wall member on top of stripped end 240. Because of the arrangement of side flange 166 and intermediate flange 172, stripped ends 210 and 240 will be securely held in the position shown on FIG. 16. Wire 242 is now electrically connected in parallel with wire 60.

The parts of modular connector 20 are economically manufactured by conventional injection molding techniques and the assembly and installation procedures are quickly performed. If desired, connections to the door members may be made in the field or they made be made during the manufacturing process. In the latter case, lengths of wires extending from the door members would be provided for attachment to other wires in the field using conventional connectors.

In addition to the provision for four pairs of wires, as described above, the present invention also contemplates that connector 20 may be arranged for a greater number of pairs of wires and/or selected slot configurations for individual wires.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A quick termination modular connector, comprising:

(a) a housing;

(b) first opening means defined through a surface of said housing to accept removably secured therein at least one first wire;

(c) at least one spring contact disposed in said housing;

(d) second opening means defined through a surface of said housing to accept removably secured therein at least one second wire; and (e) when said at least one first wire is inserted in said first opening means and said at least one second wire is inserted in said second opening means, said at least one first wire and said at least one second wire will engage said at least one spring contact and said at least one spring contact will thereafter maintain electrical contact therebetween with constant, positive pressure without the use of a mechanical fastener.

2. A quick termination modular connector, as defined in claim 1, wherein:

(a) said at least one first wire is mounted in a conventional connector plug; and (b) said at least one second wire is mounted on a door which can be removably secured in said second opening means.

3. A quick termination modular connector, as defined in claim 1, wherein: said at least one spring contact comprises a spring wire contact.

4. A quick termination modular connector, as defined in claim 3, wherein said spring wire contact comprises:

(a) a horizontal portion;

(b) an angular portion bent from a first end of said horizontal portion at an angle thereto, said angular portion to contact said at least one first wire; and (c) a generally vertical portion bent from from a second end of said horizontal portion, said generally vertical portion to contact said at least one second wire.

5. A quick termination modular connector, as defined in claim 4, wherein: said at least one second wire can be mounted on a door which can be removably secured in said second opening means and, when said at least one second wire is so mounted and said door is so mounted, a portion of said said at least one second wire will extend vertically along an inner surface of said door such that said portion of said at least one second wire will contact said generally vertical portion of said spring wire contact.

6. A quick termination modular connector, as defined in claim 4, wherein: said spring wire contact is mounted in said housing between closely fitting vertical members such that said generally vertical portion of said spring wire contact is maintained in a vertical position.

7. A quick termination modular connector, as defined in claim 5, wherein: said door includes means to mount thereon another wire extending vertically along said inner surface of said door in contact with said at least one second wire.

* * * * *